US009126100B2

(12) United States Patent
Spehar

(10) Patent No.: US 9,126,100 B2
(45) Date of Patent: Sep. 8, 2015

(54) SKI TRAINING APPARATUS

(71) Applicant: Joseph C. Spehar, Springfield, VA (US)

(72) Inventor: Joseph C. Spehar, Springfield, VA (US)

( * ) Notice: Subject to any disclaimer, the term of this patent is extended or adjusted under 35 U.S.C. 154(b) by 15 days.

(21) Appl. No.: 14/034,747

(22) Filed: Sep. 24, 2013

(65) Prior Publication Data

US 2015/0084324 A1 Mar. 26, 2015

(51) Int. Cl.

| | |
|---|---|
| ***A63C 11/22*** | (2006.01) |
| ***A63B 69/18*** | (2006.01) |
| ***A63C 5/16*** | (2006.01) |

(52) U.S. Cl.

CPC ..... *A63C 11/221* (2013.01); *A63B 69/18* (2013.01); *A63C 5/16* (2013.01); *A63C 11/22* (2013.01); *A63C 11/227* (2013.01); *A63C 11/228* (2013.01)

(58) Field of Classification Search

CPC ..... A63B 69/18; A63C 5/16; A63C 2201/12; A63C 11/221; A63C 11/22; A63C 11/227; A63C 11/228

USPC ..... 280/816, 819, 820, 823, 818; 434/253; 482/71

See application file for complete search history.

(56) References Cited

U.S. PATENT DOCUMENTS

| | | | | | |
|---|---|---|---|---|---|
| 2,490,183 | A * | 12/1949 | Wheeler | 280/606 |
| 3,885,805 | A * | 5/1975 | Solymosi | 280/606 |
| 4,214,382 | A | 7/1980 | Matsutani | |
| 4,332,399 | A * | 6/1982 | Kepple | 280/819 |
| 4,445,866 | A | 5/1984 | Cillieres | |
| 4,505,681 | A | 3/1985 | Jones | |
| 4,909,503 | A * | 3/1990 | Olson | 482/71 |
| 5,074,795 | A | 12/1991 | Clark | |
| 5,120,227 | A | 6/1992 | Born | |
| 5,378,156 | A | 1/1995 | Rohe | |
| 7,137,925 | B2 * | 11/2006 | Rozycki et al. | 482/51 |
| 7,377,551 | B2 * | 5/2008 | Silverman et al. | 280/819 |
| 8,235,423 | B2 | 8/2012 | Starry | |
| 8,529,268 | B2 * | 9/2013 | Coleman et al. | 434/253 |
| 8,544,890 | B2 * | 10/2013 | Whitehead | 280/809 |
| D717,897 | S * | 11/2014 | Spehar | D21/775 |
| 2011/0269108 | A1 * | 11/2011 | Coleman et al. | 434/253 |

* cited by examiner

*Primary Examiner* — John Walters
*Assistant Examiner* — Brian Swenson
(74) *Attorney, Agent, or Firm* — Dale J. Ream

(57) ABSTRACT

A ski training apparatus includes a ski pole having proximal and distal ends. A first guide member is coupled to an upper surface of a respective ski worn by a ski trainee and includes a first receiver portion defining a first open interior area and an open top. A second guide member includes a cylindrical configuration defining open upper and lower ends and an open interior area. A spring connects the second guide member to the first guide member, the spring having a flexible configuration such that the second guide member is repositionable relative to the first guide member. The second guide member is configured to receive the distal end of the ski pole. The second guide member is operatively coupled to the first guide member by the spring such that the ski trainer is selectively in control of the trainee's ski by manipulation of the ski pole.

14 Claims, 9 Drawing Sheets

SKI TRAINING APPARATUS

BACKGROUND OF THE INVENTION

This invention relates generally to skiing equipment and, more particularly to a ski training apparatus that enables a trainer to control the direction of the skis of a trainee with a pair of ski poles.

Children and others unfamiliar with skiing often need the assistance of a ski instructor in order to learn how to control the direction of his skis, how to stop and start, how to control his speed, and the like. Sometimes, parents try to teach their children or ski instructors seek to teach others these basic skills through oral instruction, demonstration, or while the "trainee" holds on to a rope. For instance, U.S. Pat. No. 4,505,681 proposes a handlebar held by a ski instructor that is connected to a ski student with lengthy straps that are attached to the student's waist or legs. Similarly, U.S. Pat. Nos. 4,445,866 and 5,074,795 propose various forms of tethering one or more ski instructors and students together during ski instruction or practice.

Although assumably effective for their intended purposes, these devices and methods of instruction may be ineffective or resisted by trainees who are just overly anxious to try actual skiing on their own, the trainees are often without "hands-on" assistance when embarking down a ski slope. In addition, the proposed training aids are focused on connecting a ski trainer with the body of a student rather than providing control over the direction of the student's skis.

Therefore, it would be desirable to have a ski training apparatus that enables a ski trainer to control the direction of a student's skis using the trainer's ski poles removably coupled to the student's skis. Further, it would be desirable to have a ski training apparatus having respective guide members attached to respective skis that are configured to receive distal ends of respective ski poles such that directional manipulation of the ski poles causes the direction of the skis to be changed accordingly.

SUMMARY OF THE INVENTION

A ski training apparatus according to the present invention includes a ski pole having proximal and distal ends. A first guide member is coupled to an upper surface of a respective ski worn by a ski trainee and includes a first receiver portion defining a first open interior area and an open top. A second guide member includes a cylindrical configuration defining open upper and lower ends and an open interior area. A spring connects the second guide member to the first guide member, the spring having a flexible configuration such that the second guide member is repositionable relative to the first guide member. The second guide member is configured to receive the distal end of the ski pole. The second guide member is operatively coupled to the first guide member by the spring such that the ski trainer is selectively in control of the trainee's ski by manipulation of the ski pole.

Therefore, a general object of this invention is to provide a ski training apparatus having respective guide members coupled to a student's skis and configured to receive respective ski poles of a ski trainer such that movement of the ski poles cases directional movement of the trainee's skills.

Another object of this invention is to provide a ski training apparatus, as aforesaid, in which distal ends of respective ski poles may be inserted into respective guide members coupled to rear ends of respective skis.

Still another object of this invention is to provide a ski training apparatus, as aforesaid, that enables a ski trainer to ski directly behind a ski trainee and to control the direction of trainee's skis only when desired or necessary.

Yet another object of this invention is to provide a ski training apparatus, as aforesaid, in which specialty ski poles and corresponding guide members include a quick release configuration that enables quick separation if needed.

A further object of this invention is to provide a ski training apparatus, as aforesaid, that is easy to install and use.

A still further object of this invention is to provide a ski training apparatus, as aforesaid, that is safe to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
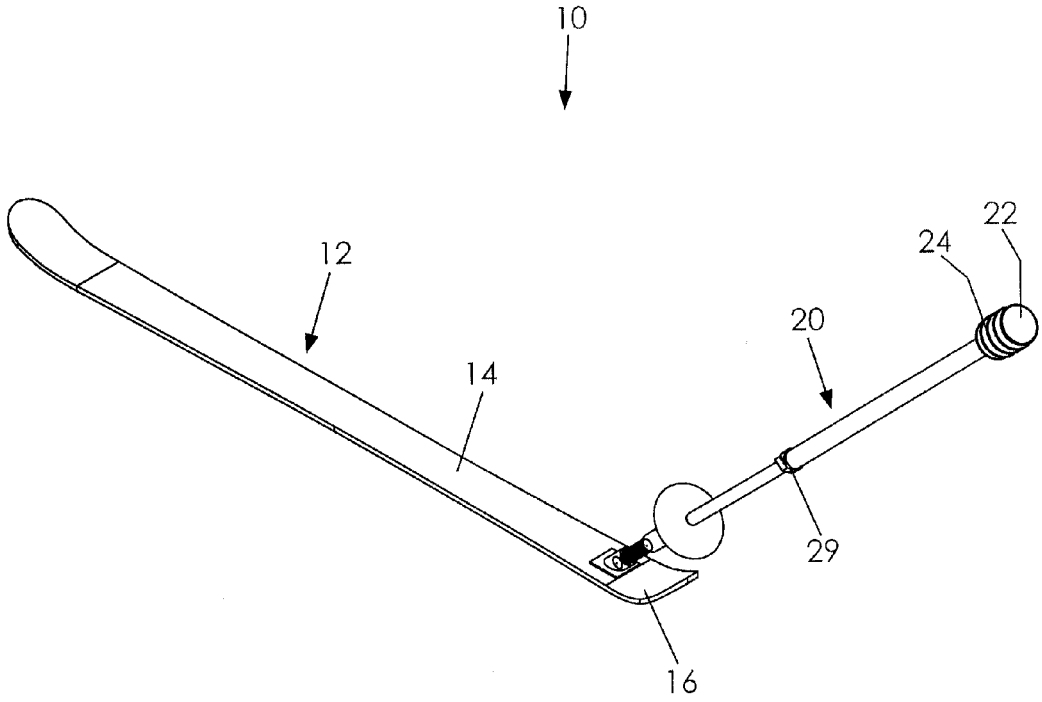
FIG. 1 is a perspective view of a ski training apparatus according to a one embodiment of the present invention.

A ski training apparatus according to a preferred embodiment of the present invention will now be described with reference to FIGS. 1 to 9 of the accompanying drawings. The ski training apparatus 10 includes a ski pole 20, a first guide member 30, a second guide member 40, and a spring 60 connecting the first and second guide members. The ski training apparatus 10 is suitable for use by a ski "trainer" in teaching a ski "trainee" how to ski. For instance, a parent, friend, or teacher may use this apparatus 10 to train a child or novice to skiing how to ski, as will be explained in more detail later.

Figure 8A:
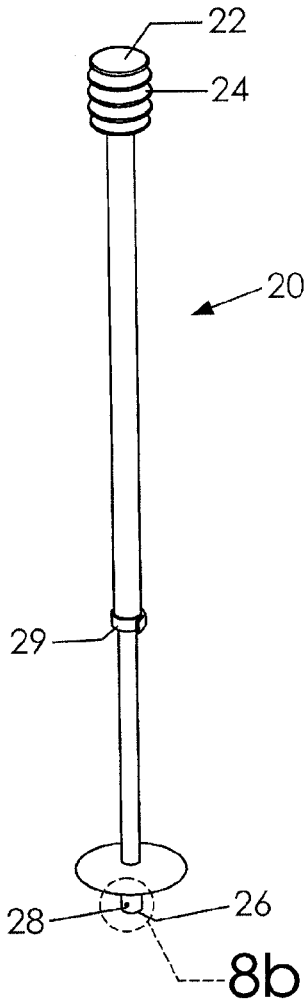
FIG. 8*a* is a side view of the ski pole as in FIG. 7*a;*
Figure 8B:
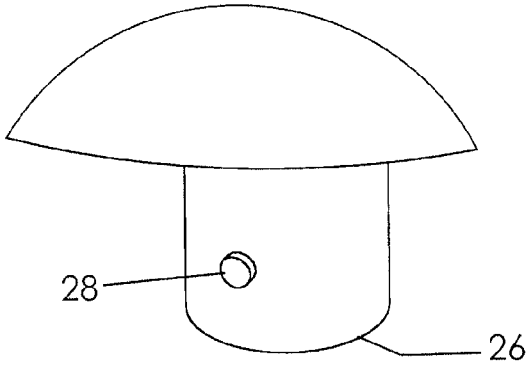
FIG. 8*b* is an isolated view on an enlarged scale taken from FIG. 8*b*.
Figure 9:
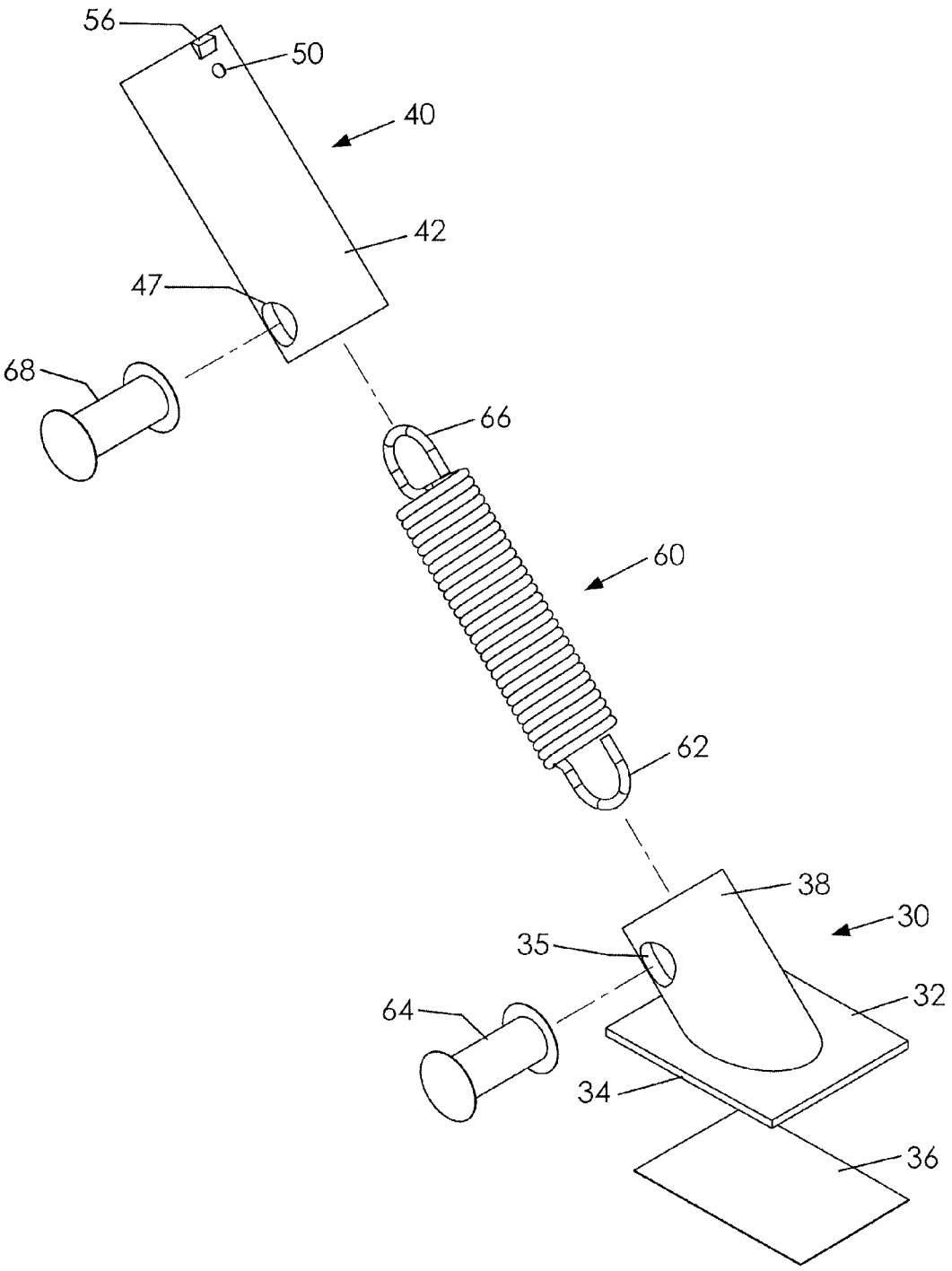
FIG. 9 is an exploded view of the ski training apparatus as in FIG. 2*a*.

The first guide member 30 includes a base portion 32 having a generally planar bottom surface 34 that may be selectively and removably coupled to an upper surface 14 of a respective ski 12 worn by the ski "trainee." More particularly, the base portion 32 may include an adhesive pad 36 or strip coupled to the bottom surface 34 and be configured so as to adhere the base portion 32 to the ski 12 (FIG. 8). Preferably, the base portion 32 of the first guide member 30 is positioned proximate a rear end 16 of the ski 12. It is understood that a first guide member 30 may be attached to the rear of both of the trainee's skis so that both may be controlled during training as will be described later.

Figure 2A:
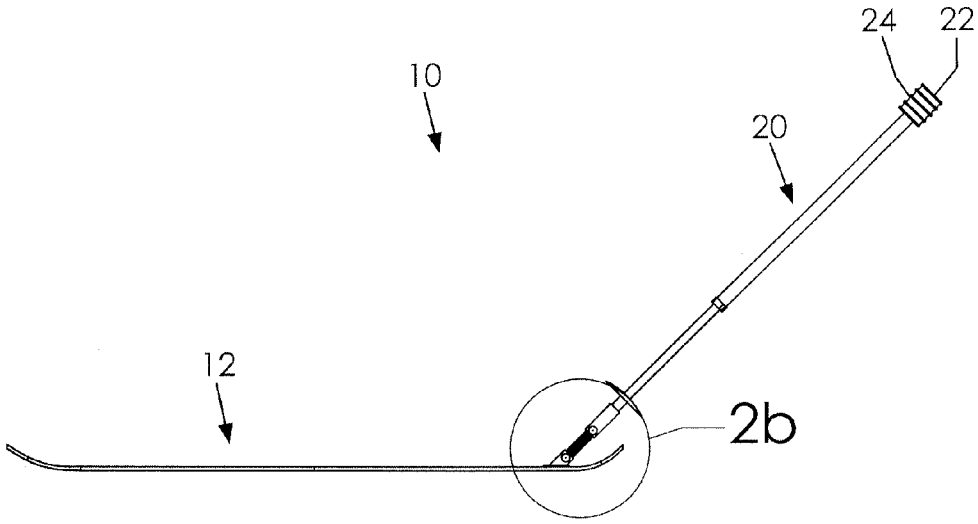
FIG. 2*a* is a side view of the ski training apparatus as in FIG. 1, illustrated with the spring in an unloaded configuration.
Figure 2B:
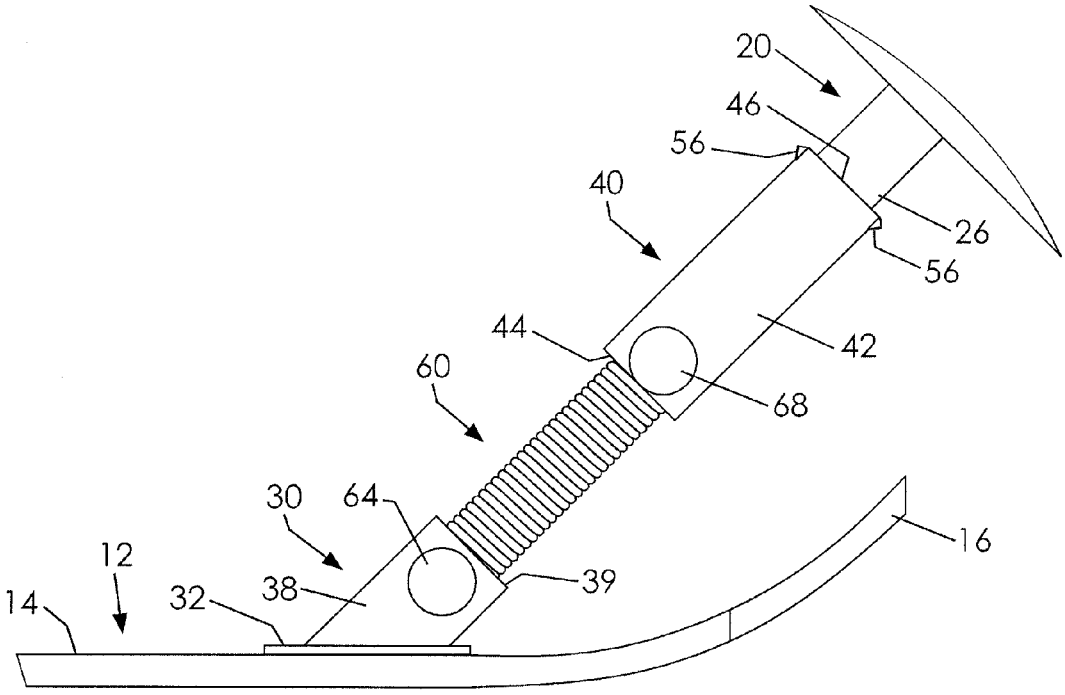
FIG. 2*b* is an isolated view on an enlarged scale taken from FIG. 2*a;*
Figure 3A:
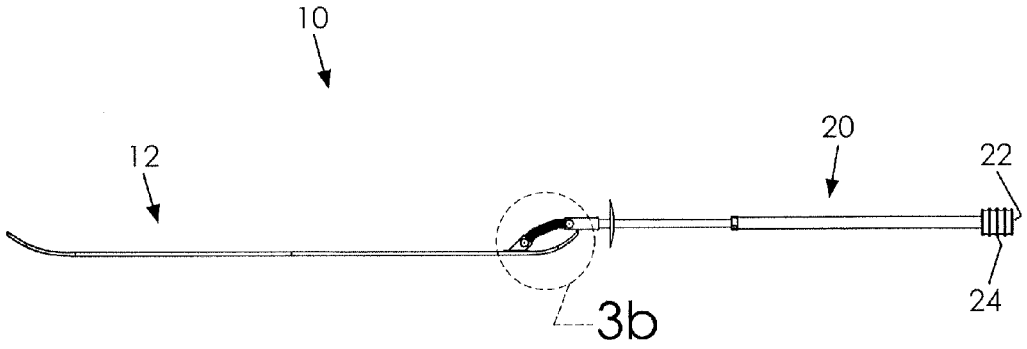
FIG. 3*a* is a side view of the ski training apparatus as in FIG. 1, illustrated with the spring in a loaded configuration.
Figure 3B:
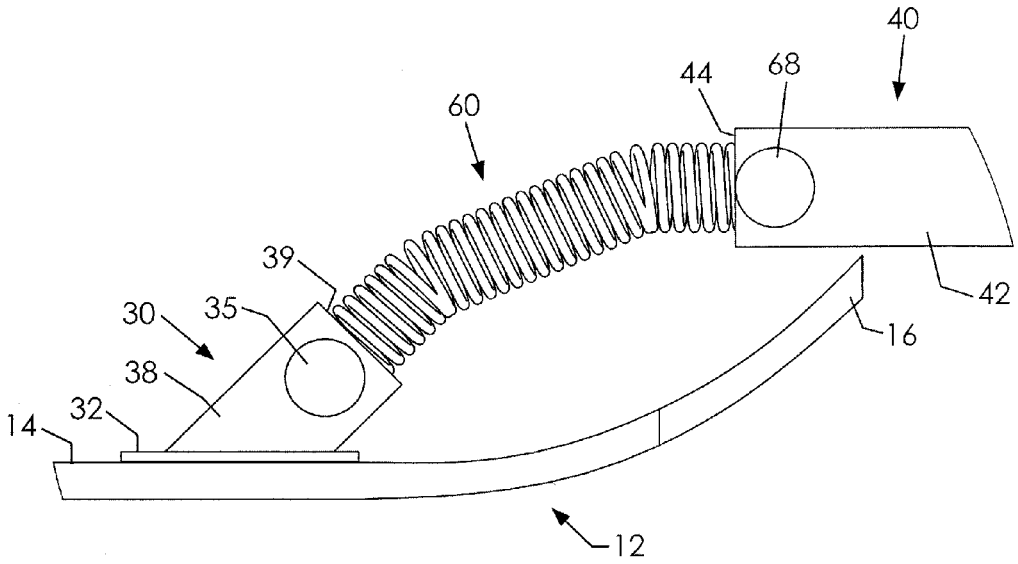
FIG. 3*b* is an isolated view on an enlarged scale taken from FIG. 3*a;*

The first guide member 30 also includes a first receiver portion 38 attached to the base portion 32 and extends upwardly therefrom (FIG. 8). Preferably, the first receiver portion 38 extends upwardly at a rearward angle, i.e. in the direction toward the rear end 16 of the ski 12 to which the first guide member 30 is attached (FIG. 2). This angular or offset relationship is understood in that the trainer will be using a ski pole 20 from a rearward position relative to the ski 12 as will be described more fully later.

The first receiver portion 38 includes a generally cylindrical configuration defining a first interior area and an open top 39 providing access thereto. In one embodiment, the first interior area and open top 39 are configured to receive the distal end 26 of the ski pole 20. When coupled together in this way, the direction of the ski 12 may be directly controlled by the ski trainer, such as according to the directional forces of the ski pole 20 held by the ski trainer. In other words, the ski pole 20 is in operational contact with the first guide member 30 and ski 12.

In a preferred embodiment, the ski training apparatus 10 includes a second guide member 40 having a cylindrical configuration. The second guide member 40 includes a continuous side wall 42. The side wall 42 defines an open interior area extending between an open lower end 44 and an open upper end 46. The second guide member 40 is configured so as to selectively receive the distal end 26 of the ski pole 20 through the upper end 46 into the open interior area.

The spring 60 is an extension spring having a flexible configuration. An extension or coil spring has loops that are touching when not under a load and which becomes longer under load. A first end 62 of the spring 60 includes a hook coupled to the first guide member 30 with a first fastener 64 such as a rivet although the first fastener 64 may be a bolt, screw, pin, clasp, or the like. The first receiver portion 38 defines a hole 35 through which the first fastener 64 is received to engage the first end 62 of the spring 60. Similarly, a second end 66 of the spring 60 includes a hook coupled to the second guide member 40 with a second fastener 68 such as a rivet although the second fastener 68 may be a bolt, screw, pin, clasp, or the like. The second guide member 40 defines a hole 47 through which the second fastener 68 is received to engage the second end 66 of the spring 60. Accordingly, the first guide member 30 is operatively connected to the second guide member 40 by the spring 60. As the second guide member 40 is not coupled to any other structure, it is free to move or be repositioned relative to the first guide member 30 as it may be urged by the trainer's manipulation of the ski pole 20.

Figure 7A:
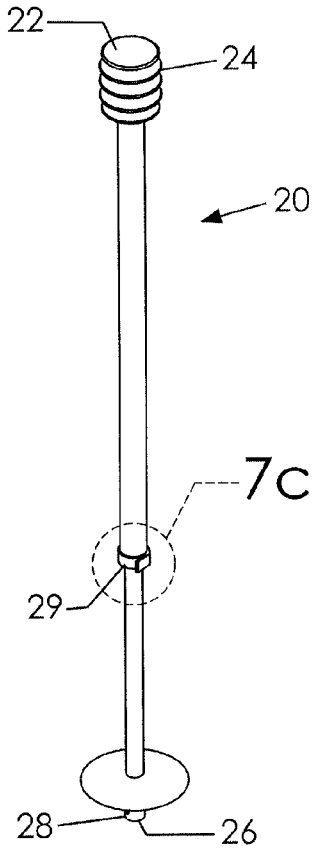
FIG. 7*a* is a perspective view of the ski pole as in FIG. 1 with a clamp in an engaged configuration.
Figure 7B:
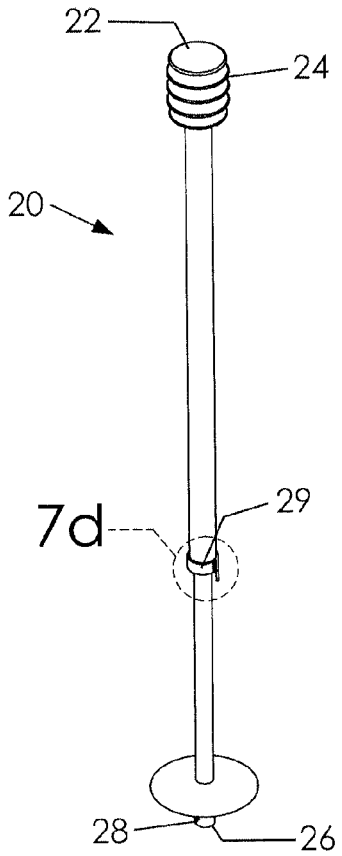
FIG. 7*b* is a perspective view of the ski pole as in FIG. 1 with a clamp in a released configuration.
Figure 7C:
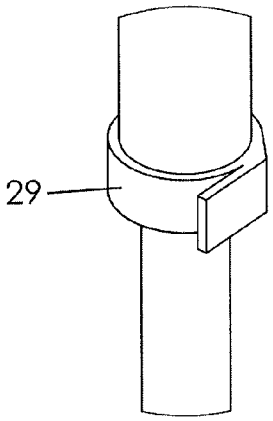
FIG. 7*c* is an isolated view on an enlarged scale taken from FIG. 7*a;*
Figure 7D:
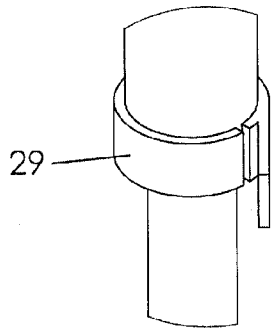
FIG. 7*d* is an isolated view on an enlarged scale taken from FIG. 7*b;*

Now with reference to the ski pole 20, the ski pole 20 may include a pin 28 adjacent a distal end 26 (FIG. 7*a*). The pin 28 may be spring loaded or otherwise movable between a compressed configuration and an extended configuration. The continuous side wall 42 of the second guide member 40 defines an aperture, also known as a first aperture 50, adjacent the upper end 46 of the second guide member 40. The first aperture 50 is configured to receive the pin 28 when the distal end 26 of the ski pole 20 is inserted into the interior area of the second guide member 40. When the ski pole 20 is inserted, the pin 28 is urged toward the compressed configuration until is registers with the first aperture 50, at which point it immediately snaps to the extended configuration through the first aperture 50 and is locked into the first aperture 50. To remove the ski pole 20 from the second guide member 40 requires the trainer to manually press the pin 28 with a finger toward the compressed configuration.

Figure 6:
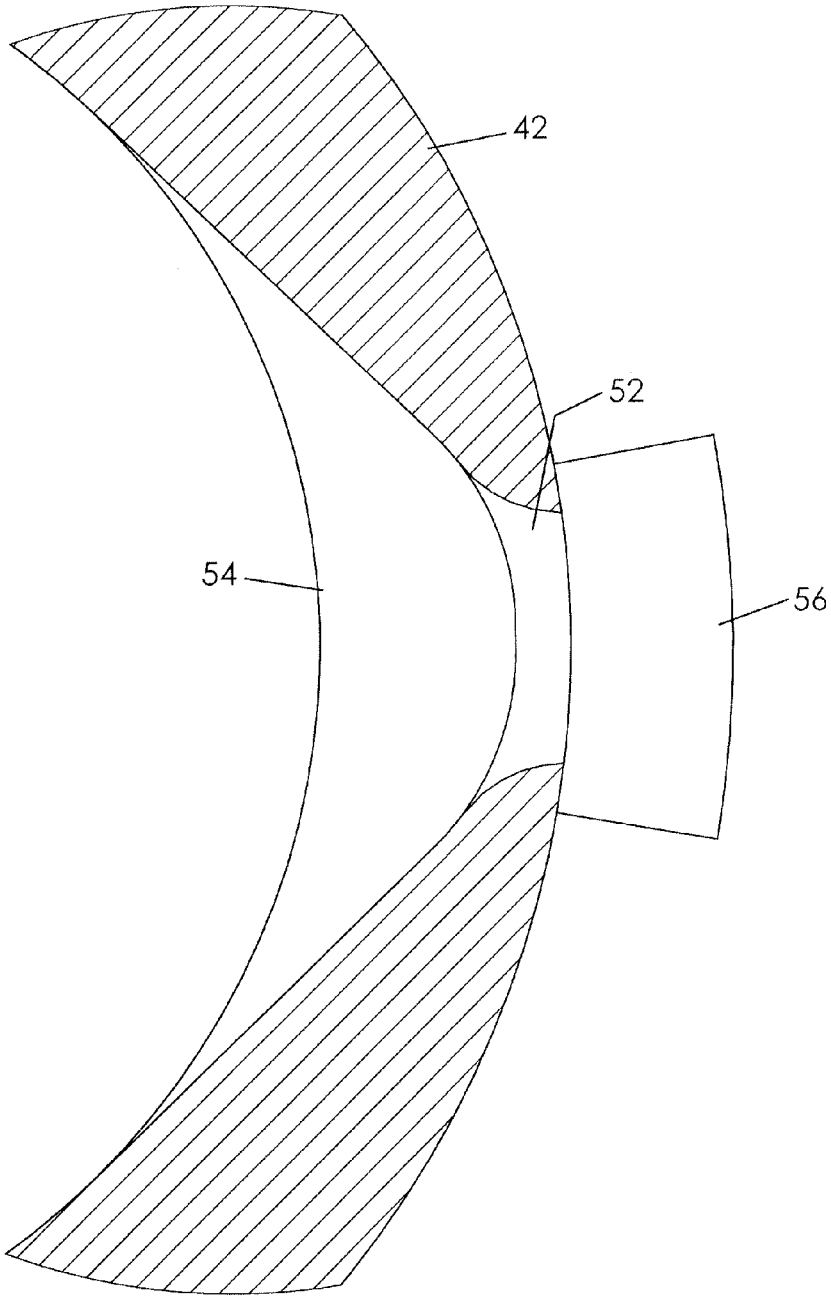
FIG. 6 is an isolated view on an enlarged scale taken from FIG. 5*b;*

Similarly, the side wall 42 of the second guide member 40 may define another aperture, also referred to as a second aperture 52 adjacent the upper end 46 of the second guide member 40. The second aperture 52 is configured to receive the pin 28 when the distal end 26 of the ski pole 20 is inserted into the interior area of the second guide member 40. Unlike the first aperture 50, however, the second aperture 52 includes a smaller diameter at an outer surface of the side wall 42 than at an inner surface of the side wall 42. The second aperture 52 also includes a ramp section 54 configured to increasingly urge the pin 28 toward the compressed configuration when the ski pole 20 is rotated relative to the second aperture 52 such that the pin 28 is selectively released from the second aperture 52 by said rotation (FIG. 6). In use, this feature provides a quick release of the ski pole 20 from the second guide member 40, such as if there is a medical emergency, if the trainer or trainee has fallen, or the like.

Figure 4A:
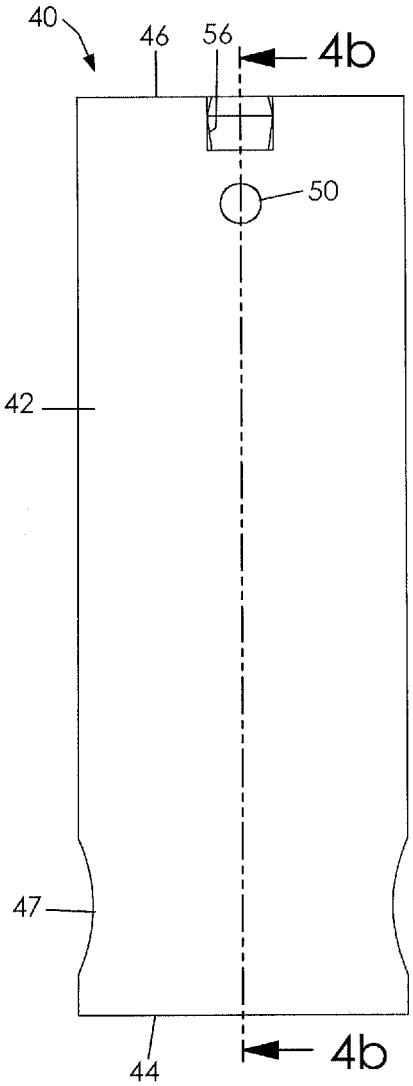
FIG. 4*a* is a side view of a second guide member removed from the ski training apparatus of claim 1.
Figure 4B:
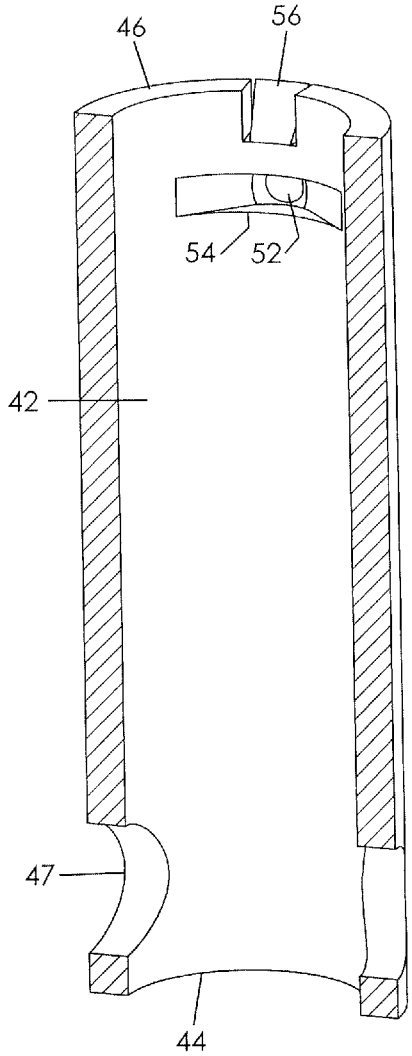
FIG. 4*b* is a sectional view taken along line 4*b*-4*b* of FIG. 4*a;*
Figure 5A:
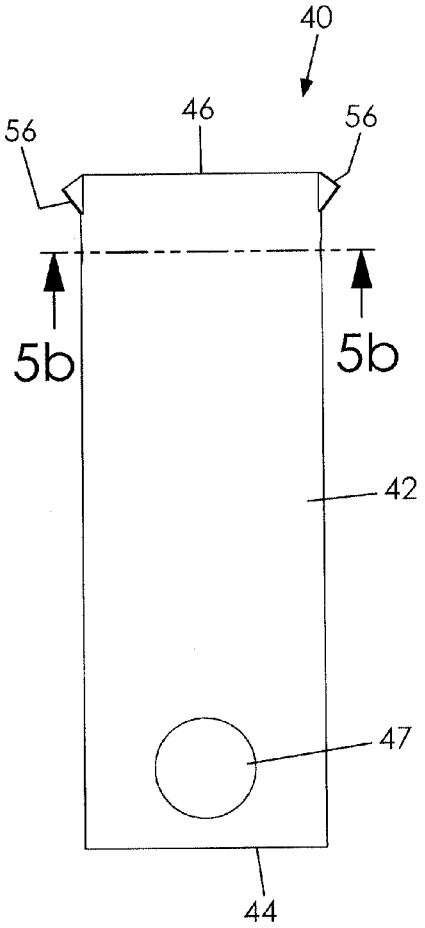
FIG. 5*a* is a side view taken from another angle of the second guide member.
Figure 5B:
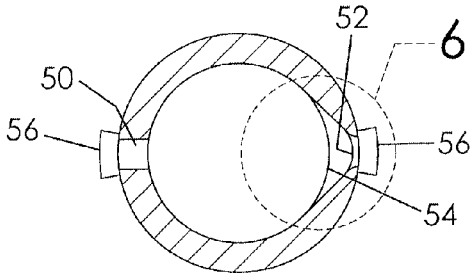
FIG. 5*b* is a sectional view taken along line 5*b*-5*b* of FIG. 5*a;*

In one embodiment, this second aperture 52 may be the sole aperture. In another embodiment, the side wall 42 of the second guide member 40 may include both the first aperture 50 and the second aperture 52. In the case of both apertures being included, the first aperture 50 is directly opposite the second aperture 52 as shown in FIGS. 4*b* and 5*b*. In this embodiment, the functionality of the ski pole 20 will depend on which aperture the pin 28 is inserted into.

With further reference to the second guide member 40, the side wall 42 defines at least one receiver lip 56 situated at the upper end 46. The receiver lip 56 extends outwardly so as to increase the diameter of the open upper end 46, thus making it easier to receive the distal end 26 and pin 28 of the ski pole 20. Preferably, the side wall 42 defines a pair of opposed receiver lips 56 so as to receive the pin 28 of the ski pole 20 into a desired aperture 50, 52 as described above. As shown in FIGS. 5*b* and 8, a respective lip 56 is in vertical alignment and proximate to a respective aperture such that the pin 28 having been received in a respective lip 56 is subsequently captured in a corresponding aperture as the ski pole 20 is urged further into the second guide member 40.

In one embodiment, the ski pole 20 includes a handle 24 at a proximal end 22 thereof that is to grip by a trainer and with which to manipulate the distal end 26 of the ski pole 20 into the second guide member 40. Further, the ski pole 20 may include a lower portion and an upper portion that are length adjustable so as to vary the overall length of the pole 20. The ski pole 20 may include a clamp 29 configured to hold the upper and lower portions at a desired length adjustment.

In use, a ski training apparatus 10 may be installed onto each ski 12 of a trainee's pair of ski's by adhering a respective first guide member 30 to a rear end 16 of each ski 12 as described above. Once on the ski slope and ready to descend a hill, the trainer may insert a ski pole 20 into respective second guide members 40 and secure the ski pole pin 28 into a desired aperture 50 or 52. It is understood that the apparatus 10 includes a pair of ski poles—one corresponding with each ski 12. As the trainer and trainee descend the hill, the trainer can use respective ski poles to urge the back of the trainee's respective skis to the left or right as needed to keep the trainee straight or to intentionally turn.

It is understood that while certain forms of this invention have been illustrated and described, it is not limited thereto except insofar as such limitations are included in the following claims and allowable functional equivalents thereof.

The invention claimed is:

1. A ski training apparatus for use by a ski trainer to assist a ski trainee wearing a pair of skis in learning the activity of skiing, comprising:

a ski pole having a proximal end configured to be grasped by the ski trainer and a distal end opposite said proximal end, said ski pole having an elongate and linear configuration;

a first guide member having a base portion coupled to an upper surface of a respective ski of the pair of skis worn by the ski trainee and a first receiver portion extending upwardly from said base portion, said first receiver portion having a generally cylindrical configuration defining a first open interior area and an open top;

wherein said first receiver portion is selectively and operatively coupled to said distal end of said ski pole so that the ski trainer is selectively in control of the trainee's ski by manipulation of said ski pole when coupled to said first receiver portion of said first guide member;

a second guide member includes a cylindrical configuration defining opposed open upper and lower ends and defining an open interior area; and a spring coupling said second guide member to said first guide member, said spring having a flexible configuration such that said second guide member is selectively repositionable relative to said first guide member;

wherein said upper end and said interior area of said second guide member are configured to receive said distal end of said ski pole into said interior area, said second guide member being operatively coupled to said first guide member by said spring such that the ski trainer is selectively in control of the trainee's ski by manipulation of said ski pole.

2. The ski training apparatus as in claim 1, wherein:

said first guide member is situated adjacent a rear end of the respective ski to which said first guide member is coupled; and said receiver portion of said first guide member extends upwardly at an angle directed toward the rear end of the respective ski.

3. The ski training apparatus as in claim 1, wherein:

said spring includes a first end coupled to said first guide member with a fastener adjacent said open top; and said spring includes a second end coupled to said second guide member with a fastener adjacent said lower end.

4. The ski training apparatus as in claim 1, wherein said spring is an extension spring.

5. The ski training apparatus as in claim 1, wherein said base portion of said first guide member includes an adhesive member coupled to a bottom surface thereof and configured to adhere said base portion to the respective ski.

6. The ski training apparatus as in claim 1, wherein:

said ski pole includes a pin positioned on a side thereof proximate said distal end, said pin being movable between a compressed configuration and an extended configuration; and said second guide member includes a continuous side wall extending between said upper end and said lower end, said side wall defining an aperture adjacent said upper end configured to receive said pin when said distal end of said ski pole is received into said interior area of said second guide member.

7. The ski training apparatus as in claim 6, wherein said side wall of said second guide member includes at least one receiver lip situated at said upper end and that extends outwardly, said at least one receiver lip being proximate said aperture such that said pin is aligned for receipt into said aperture when said pin is received into said at least one receiver lip.

8. The ski training apparatus as in claim 6, wherein:

said pin is urged toward said compressed configuration as said ski pole distal end is inserted into said upper end of said second guide member and is normally biased to move to said extended configuration into said aperture; and said ski pole is not removable from said second guide member until said pin is manually moved to said compressed configuration by the ski trainer.

9. The ski training apparatus as in claim 1, wherein:

said ski pole includes a pin positioned on a side thereof proximate said distal end, said pin being movable between a compressed configuration and an extended configuration;

said second guide member includes a continuous side wall extending between said upper end and said lower end, said side wall defining an aperture adjacent said upper end configured to receive said pin when said distal end of said ski pole is received into said interior area of said second guide member; and said aperture includes a smaller diameter at an outer surface of said side wall than at an inner surface of said side wall, said aperture including a ramp section dimensioned to increasingly urge said pin toward said compressed configuration when said ski pole is rotated relative to said aperture, whereby said pin is selectively released from aperture upon rotation of said ski pole.

10. The ski training apparatus as in claim 9, wherein said side wall of said second guide member includes at least one receiver lip situated at said upper end and that extends outwardly, said at least one receiver lip being proximate said aperture such that said pin is aligned for receipt into said aperture when said pin is received into said at least one receiver lip.

11. The ski training apparatus as in claim 1, wherein:

said ski pole includes a pin positioned on a side thereof proximate said distal end, said pin being movable between a compressed configuration and an extended configuration;

said second guide member includes a continuous side wall extending between said upper end and said lower end, said side wall defining a first aperture adjacent said upper end configured to receive said pin when said distal end of said ski pole is received into said interior area of said second guide member;

said side wall defines a second aperture opposite said first aperture and configured to receive said pin when said distal end of said ski pole is received into said interior area of said second guide member; and said second aperture includes a smaller diameter at an outer surface of said side wall than at an inner surface of said side wall, said second aperture including a ramp section dimensioned to increasingly urge said pin toward said compressed configuration when said ski pole is rotated relative to said second aperture, whereby said pin is selectively released from second aperture upon rotation of said ski pole.

12. The ski training apparatus as in claim 11, wherein said side wall of said second guide member includes at least one receiver lip situated at said upper end and that extends outwardly, said at least one receiver lip being proximate said aperture such that said pin is aligned for receipt into said first aperture when said pin is received into said at least one receiver lip.

13. The ski training apparatus as in claim 1, wherein said ski pole includes a handle at said proximal end thereof configured to be held by the ski trainer.

14. The ski training apparatus as in claim 1, wherein said ski pole is length adjustable.

* * * * *